US011400707B2

(12) United States Patent
Kondo

(10) Patent No.: US 11,400,707 B2
(45) Date of Patent: Aug. 2, 2022

(54) RECORDING DEVICE AND RECORDING METHOD

(71) Applicant: SEIKO EPSON CORPORATION, Tokyo (JP)

(72) Inventor: Takamitsu Kondo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/202,457

(22) Filed: Mar. 16, 2021

(65) Prior Publication Data

US 2021/0291515 A1 Sep. 23, 2021

(30) Foreign Application Priority Data

Mar. 18, 2020 (JP) ..... JP2020-047865

(51) Int. Cl.
*B41J 2/045* (2006.01)
*B41M 5/00* (2006.01)

(52) U.S. Cl.
CPC ..... *B41J 2/04558* (2013.01); *B41J 2/04586* (2013.01); *B41M 5/0011* (2013.01)

(58) Field of Classification Search
CPC ..... B41J 2/04558; B41J 2/04586; B41M 5/001
See application file for complete search history.

(56) References Cited

U.S. PATENT DOCUMENTS

2005/0083363 A1* 4/2005 Ishikawa ..... B41J 2/2114 347/15

FOREIGN PATENT DOCUMENTS

| | | |
|---|---|---|
| JP | 2014-031021 A | 2/2014 |
| JP | 2017-160577 A | 9/2017 |
| JP | 2017-222036 A | 12/2017 |

* cited by examiner

*Primary Examiner* — Thinh H Nguyen

(74) *Attorney, Agent, or Firm* — Global IP Counselors, LLP

(57) ABSTRACT

Provided is a recording device including a recording head, and a control unit. The control unit is configured to cause the recording head to record each of a raster lines of an overlapping region of an image by an overlap mode of recording one raster line using a plurality of a first nozzles, record a penetrant liquid in at least a portion of an overlapping region by a second nozzles, and record the penetrant liquid in a region of the image other than the overlapping region in an amount less than that of the penetrant liquid recorded in the at least a portion of the overlapping region.

8 Claims, 10 Drawing Sheets

60

| OL RASTER NUMBER | NOZZLE USAGE RATE (PRECEDING PASS : SUCCEEDING PASS) | USAGE RATE DIFFERENCE | PENETRANT LIQUID DOT ON/OFF |
|---|---|---|---|
| 1 | 90% : 10% | 80% | OFF |
| 2 | 80% : 20% | 60% | OFF |
| 3 | 70% : 30% | 40% | ON |
| 4 | 60% : 40% | 20% | ON |
| 5 | 40% : 60% | 20% | ON |
| 6 | 30% : 70% | 40% | ON |
| 7 | 20% : 80% | 60% | OFF |
| 8 | 10% : 90% | 80% | OFF |

FIG. 9

RECORDING DEVICE AND RECORDING METHOD

The present application is based on and claims priority from JP Application Serial Number 2020-047865, filed Mar. 18, 2018, the disclosure of which is hereby incorporated by reference herein in its entirety.

BACKGROUND

1. Technical Field

The present disclosure relates to a recording device and a recording method.

2. Related Art

There are known printers configured to record an image onto a recording medium by alternately repeating a scan, in a main scanning direction, of a recording head including a nozzle row constituted by a plurality of nozzles configured to eject ink, and a transport of the recording medium in a transport direction intersecting the main scanning direction. Such a printer partially overlaps an image region recorded by a given scan and an image region recorded by the next scan, making it possible to record the image regions recorded by each scan without occurrence of a gap therebetween.

Each raster line extending in the main scanning direction and forming the overlapping region as described above is recorded using a plurality of nozzles. Such a manner of recording is referred to as overlap mode. This overlap mode is also described in JP-A-2014-31021. Hereinafter, the term "overlap" is abbreviated as OL.

In recording results, a difference in density readily occurs in the image between the OL recording region recorded by the OL mode and a normal recording region, which is a region other than the OL recording region. Given that the total recorded amount of ink per unit area is the same for the OL recording region and the normal recording region, the recorded amount per unit area by one scan of the recording head is, for the OL recording region, approximately half the recorded amount for the normal recording region. Therefore, a degree of penetration of the ink into the recording medium is typically lower in the OL recording region than in the normal recording region. Such a difference in the degree of penetration of the ink causes the difference in density described above.

Specifically, when a recording surface, which is the surface among the two surfaces of the recording medium that receives the ejection of ink, is observed, the OL recording region has a lower degree of ink penetration toward the non-recording surface on a side opposite to the recording surface than the normal recording region, and therefore more readily increases in density. Such a difference in density is recognized as a density irregularity.

SUMMARY

A recording device includes a recording head including a plurality of first nozzles configured to eject a first ink and a plurality of second nozzles configured to eject a penetrant liquid that promotes penetration of the first ink into a recording medium, and a control unit configured to control the recording head to eject the first ink onto the recording medium, thereby recording onto the recording medium an image including a plurality of raster lines extending in a first direction and formed side by side in a second direction intersecting the first direction. The control unit is configured to cause the recording head to record each raster line of the plurality of raster lines of an overlapping region of the image by an overlap mode of recording one raster line using a plurality of the first nozzles, record the penetrant liquid in at least a portion of the overlapping region by the second nozzles, and record the penetrant liquid in a region of the image other than the overlapping region in an amount less than that of the penetrant liquid recorded in the at least a portion of the overlapping region.

A recording method of controlling a recording head including a plurality of first nozzles configured to eject a first ink and a plurality of second nozzles configured to eject a penetrant liquid that promotes penetration of the first ink into a recording medium to eject the first ink onto the recording medium, thereby recording onto the recording medium an image including a plurality of raster lines extending in a first direction and formed side by side in a second direction intersecting the first direction, the recording method including causing the recording head to record each of the raster lines of an overlapping region of the image by an overlap mode of recording one raster line using a plurality of the first nozzles, record the penetrant liquid in at least a portion of the overlapping region by the second nozzles, and record the penetrant liquid in a region of the image other than the overlapping region in an amount less than that of the penetrant liquid recorded in the at least a portion of the overlapping region.

BRIEF DESCRIPTION OF THE DRAWINGS

FIG. 9 illustrates a nozzle usage rate table.

DESCRIPTION OF EXEMPLARY EMBODIMENTS

Exemplary embodiments of the present disclosure will be described below with reference to the drawings. Note that each of the drawings is merely an example for explaining the exemplary embodiment. Because each drawing is an example, the proportions and shapes may not be accurate, the drawings may not be consistent with each other, and a portion may be omitted.

1. General Description of Device

Figure 1:
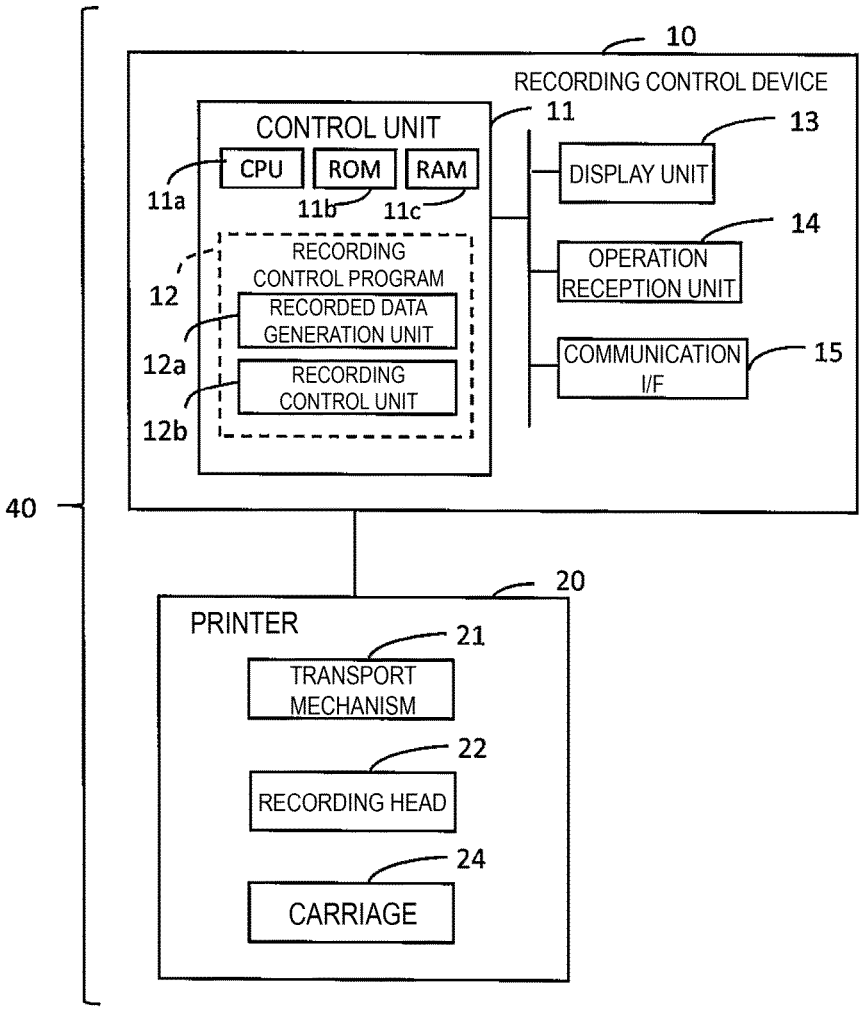
FIG. 1 is a block diagram illustrating a simplified configuration related to an exemplary embodiment.

FIG. 1 illustrates a simplified configuration of a system 40 according to an exemplary embodiment. The system 40 includes a recording control device 10 and a printer 20. The system 40 may be referred to as a recording system, an image processing system, a printing system, or the like. A recording method is realized by at least a portion of the system 40.

The recording control device 10 is realized by, for example, a personal computer, a server, a smartphone, a tablet terminal, or an information processing device having the same degree of processing capability as these. The recording control device 10 includes a control unit 11, a display unit 13, an operation reception unit 14, a communication interface 15, and the like. The term "interface" is abbreviated as IF. The control unit 11 is configured to include one or a plurality of integrated circuits (ICs) including a central processing unit (CPU) 11*a*, a read only memory (ROM) 11*b*, a random access memory (RAM) 11*c*, and the like as a processor, other non-volatile memory, and the like.

In the control unit 11, the processor, that is, the CPU 11*a*, executes arithmetic processing according to a program stored in the ROM 11*b*, other memory, or the like, using the RAM 11*c* or the like as a work area. The control unit 11 executes processing according to a recording control program 12, thereby realizing a plurality of functions such as a recorded data generation unit 12*a* and a recording control unit 12*b* in cooperation with the recording control program 12. Note that the processor is not limited to a single CPU, and may have a configuration in which processing is performed by a plurality of CPUs or a hardware circuit such as an application-specific integrated circuit (ASIC), or may have a configuration in which processing is performed with a CPU and a hardware circuit working in cooperation.

The display unit 13 is a means for displaying visually recognized information, and is constituted by, for example, a liquid crystal display or an organic electroluminescent (EL) display. The display unit 13 may have a configuration that includes a display and a driving circuit for driving the display. The operation reception unit 14 is a means for receiving an operation by a user, and is realized by, for example, a physical button, a touch panel, a mouse, or a keyboard. Of course, the touch panel may be realized as one function of the display unit 13. The display unit 13 and the operation reception unit 14 can collectively be referred to as an operating panel of the recording control device 10.

The display unit 13 and the operation reception unit 14 may be a portion of the configuration of the recording control device 10, but may be a peripheral device external to the recording control device 10. The communication IF 15 is a generic term for one or a plurality of IFs used by the recording control device 10 to perform wired or wireless communication with the outside in accordance with a predetermined communication protocol including a known communication standard. The control unit 11 communicates with the printer 20 via the communication IF 15.

The printer 20, as a recording device controlled by the recording control device 10, is an inkjet printer that ejects a liquid such as ink to record an image. A drop of liquid ejected by the printer 20 is referred to as a dot. Although a detailed description of the inkjet printer is omitted herein, the printer 20 generally includes a transport mechanism 21, a recording head 22, and a carriage 24.

The transport mechanism 21 includes a roller that transports the recording medium, a motor for driving the roller, and the like, and transports the recording medium in a predetermined transport direction.

Figure 2:
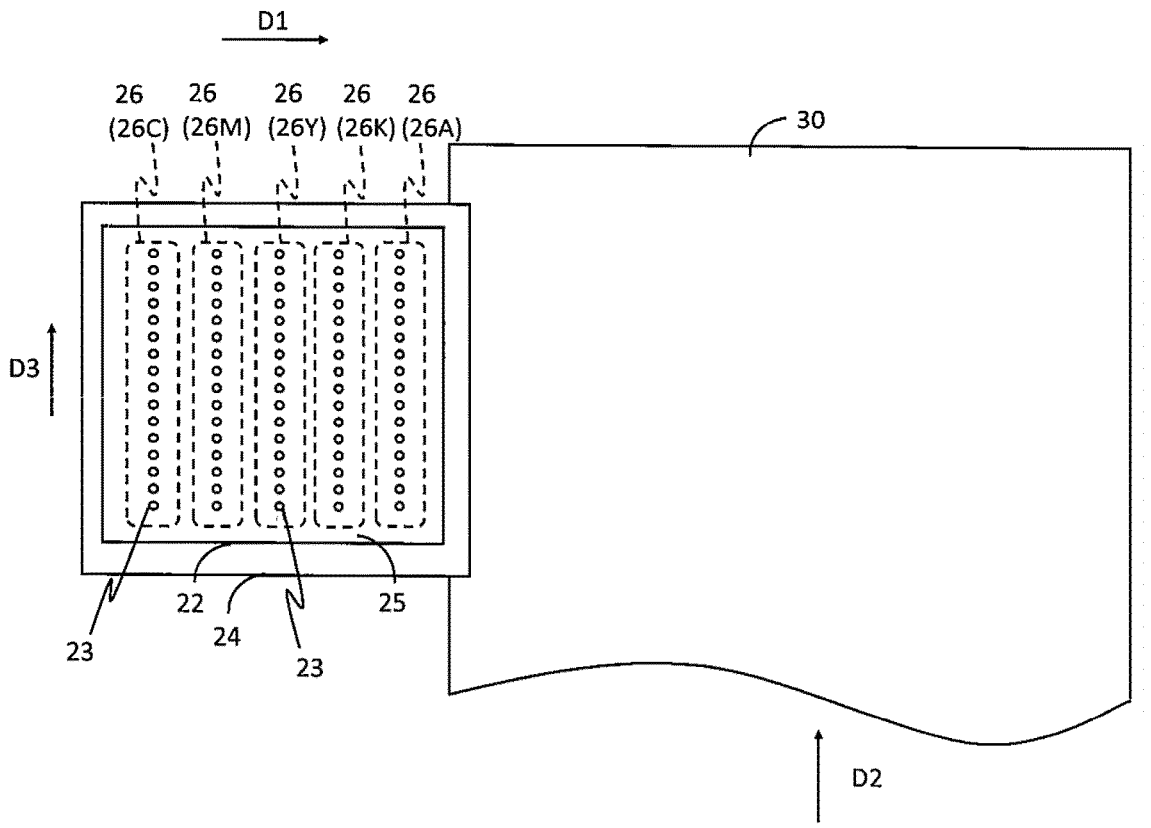
FIG. 2 is a diagram illustrating an example of a relationship between a recording medium and a recording head from a viewpoint from above.

As illustrated in FIG. 2, the recording head 22 includes a plurality of nozzles 23 configured to eject dots, and the dots are ejected from each of the nozzles 23 onto a recording medium 30 transported by the transport mechanism 21. The printer 20 controls application of a drive signal to a drive element (not illustrated) included in the nozzle 23 in accordance with recorded data described later, causing the dots to be ejected or not ejected from the nozzle 23. For example, the printer 20 performs recording by ejecting ink of each color of cyan (C), magenta (M), yellow (Y), and black (K), and ink of colors other than these colors. In this exemplary embodiment, each ink having one of these colors corresponds to a "first ink". Furthermore, the recording head 22 is configured to eject a penetrant liquid that promotes penetration of the first ink into the recording medium 30. A penetrant liquid is also referred to as a penetrant. The penetrant liquid can also be regarded as a type of ink, in which case the penetrant liquid is referred to as a "second ink" to distinguish it from the first ink.

In the following, the term "ink" simply refers to the first ink unless otherwise specified.

FIG. 2 illustrates a simplified relationship between the recording head 22 and the recording medium 30. The recording head 22 may be referred to as a printing head, a print head, a liquid ejection head, and the like. In this exemplary embodiment, the recording medium 30 is assumed to be fabric. The printer 20 that performs recording onto the fabric may be referred to as a textile printer.

The recording head 22 is mounted on the carriage 24 reciprocally movable in a first direction D1 and moves with the carriage 24. That is, the carriage 24 is movable in the first direction D1 and in a reverse direction of the first direction D1. Movement of the carriage 24 in the first direction D1 is referred to as forward movement, and movement in the reverse direction of the first direction D1 is referred to as return movement. Such a first direction D1 and a reverse direction of the first direction D1 are also referred to as a main scanning direction.

The transport mechanism 21 transports the recording medium 30 in a second direction D2 intersecting the first direction D1. The second direction D2 is the transport direction. The intersection between the first direction D1 and the second direction D2 may be understood as orthogonal. However, due to various errors in the printer 20 as a product, for example, the first direction D1 and the second direction D2 may not be strictly orthogonal.

Reference sign 25 denotes a nozzle surface 25 in which the nozzles 23 of the recording head 22 open. FIG. 2 illustrates an example of an array of the nozzles 23 in the nozzle surface 25. Each small circle in the nozzle surface 25 is the nozzle 23. The recording head 22 is provided with a plurality of nozzle rows 26 in a configuration in which the supply of the ink of each CMYK color and the penetrant liquid is received from a liquid holding means (not illustrated), called an ink cartridge, an ink tank, or the like, mounted on the printer 20, and ejected from the nozzles 23. The nozzle row 26 formed of the nozzles 23 that eject the C ink is also denoted as a nozzle row 26C. Similarly, the nozzle row 26 formed of the nozzles 23 that eject the M ink, the nozzle row 26 formed of the nozzles 23 that eject the Y ink, the nozzle row 26 formed of the nozzles 23 that eject the K ink, and the nozzle row 26 that ejects the penetrant liquid are denoted as a nozzle row 26M, a nozzle row 26Y, a nozzle row 26K, and a nozzle row 26A, respectively. The nozzle rows 26C, 26M, 26Y, 26K, 26A are aligned in the first direction D1.

Each of the nozzle rows 26 is constituted by a plurality of the nozzles 23 in which a nozzle pitch, which is a distance between the nozzles 23 in the second direction D2, is constant or substantially constant. The direction in which the plurality of nozzles 23 constituting the nozzle row 26 is aligned is referred to as a nozzle row direction D3. In the example of FIG. 2, the nozzle row direction D3 is parallel with the second direction D2 serving as the transport direction. In a configuration in which the nozzle row direction D3 is parallel with the second direction D2, the nozzle row direction D3 and the first direction D1 are orthogonal. However, the nozzle row direction D3 may be configured to obliquely intersect the first direction D1 rather than be parallel with the second direction D2. In any case, it can be said that the plurality of nozzles 23 constituting the nozzle row 26 are aligned with the nozzle pitch in the second direction D2 in a constant or substantially constant state, and therefore the plurality of nozzles 23 constituting the nozzle row 26 are aligned in the second direction D2.

The respective positions of the nozzle rows 26C, 26M, 26Y, 26K, 26A in the second direction D2 are aligned with each other. Each of the nozzle rows 26C, 26M, 26Y, and 26K that eject the CMYK ink, which are types of the first ink, corresponds to a "first nozzle row", and each of the nozzles 23 constituting the first nozzle row corresponds to a "first nozzle". On the other hand, the nozzle row 26A that ejects the penetrant liquid corresponds to a "second nozzle row", and each of the nozzles 23 constituting the second nozzle row corresponds to a "second nozzle". In the example in FIG. 2, among the nozzle rows 26C, 26M, 26Y, 26K, 26A in the first direction D1, the nozzle row 26A is positioned outermost in an order of the nozzle rows 26.

According to the example in FIG. 2, the printer 20 is a so-called serial printer, and records an image onto the recording medium 30 by alternately repeating a transport of a predetermined transport amount (hereinafter, feed amount) of the recording medium 30 in the second direction D2 and an ink ejection by the recording head 22 associated with movement of the carriage 24 in the first direction D1. The operation in which the recording head 22 ejects a liquid such as ink in association with a forward movement or a return movement of the carriage 24 is referred to as a "scan" or a "pass".

The recording control device 10 and the printer 20 may be coupled via a network (not illustrated). The printer 20 may be a multifunction device having a plurality of functions such as a scanner function and a facsimile communication function in addition to the printing function. The recording control device 10 may be realized not by just one independent information processing device, but by a plurality of information processing devices communicatively coupled to each other via a network.

Alternatively, the recording control device 10 and the printer 20 may be a recording device in which these are integrated. That is, the system 40 may actually be a single recording device 40 including the recording control device 10 and the printer 20. Accordingly, the processing executed by the recording control device 10 described below may be understood as processing executed by the recording device 40.

2. Recording Control Processing

Figure 3:
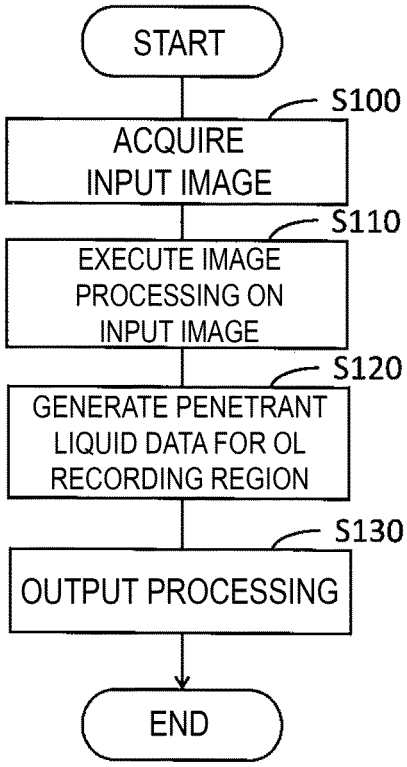
FIG. 3 is a flowchart illustrating recording control processing.

FIG. 3 illustrates, in a flowchart, recording control processing realized by the control unit 11 in accordance with the recording control program 12. By the recording control processing, the control unit 11 controls the printer 20, causing the printer 20 to record, onto the recording medium 30, an image in which a plurality of "raster lines" extending in the first direction D1 are formed side by side in the second direction D2. Further, in this exemplary embodiment, an OL mode is employed to record an overlapping region of the image. The recording method according to this exemplary embodiment is realized by the recording control processing.

The control unit 11 starts the recording control processing on the basis of accepting a recording instruction for an input image. In step S100, the recorded data generation unit 12*a* acquires the input image. The user, for example, operates the operation reception unit 14 while viewing a UI screen displayed on the display unit 13, thereby selecting the input image as desired and providing a recording instruction for the input image. UI is an abbreviation for user interface. The recorded data generation unit 12*a* acquires the input image thus selected from a storage source such as a predetermined memory.

The input image acquired in step S100 is, for example, image data in a bitmap format by which each pixel is expressed by a combination of gray scale values of red (R), green (G), and blue (B). The gray scale values of one color are expressed in, for example, 256 gradations of 0 to 255. Of course, the recorded data generation unit 12*a* may generate image data in which each pixel is expressed in RGB by converting the format of the input image acquired in step S100, as necessary.

In step S110, the recorded data generation unit 12*a* performs image processing on the input image, thereby generating recorded data for the printer 20 to record the input image. In this case, the recorded data generation unit 12*a* performs color conversion processing on the image data of the input image. That is, the color system of the image data is converted to the color system of the ink used by the printer 20 for recording. When the printer 20 is a model that uses the CMYK ink as the first ink as in the example in FIG. 2, the recorded data generation unit 12*a* converts the RGB gray scale values for each pixel to CMYK gray scale values. The color conversion processing can be executed by referring to any color conversion lookup table that defines a conversion relationship from RGB to CMYK.

The recorded data generation unit 12*a* generates the recorded data of the first ink by performing halftone processing on the image data after the color conversion, that is, the image data in which each pixel has gray scale values indicating the ink amount per CMYK. The halftone processing is executed using, for example, a dither method or an error diffusion method. The recorded data of the first ink are data defining dot ejection (dot-on) or non-ejection (dot-off) for each pixel and for each CMYK. Of course, the dot-on information may be information defining which of a plurality of predetermined sizes of dots, such as large dots, medium dots, and small dots, for example, is to be ejected.

In step S120, the recorded data generation unit 12*a* generates penetrant liquid data corresponding to an "OL recording region", which is an overlapping region of the input image. The OL recording region is an image region formed by "OL raster lines" which are raster lines recorded by the OL mode. According to the OL mode, given a scenario in which one raster line is recorded with one color of ink, the raster line is divisionally recorded by a plurality of the nozzles 23 that eject ink of that one color. When the printer 20 is a serial printer, one OL raster line is recorded in a plurality of passes. For convenience, a raster line that is not an OL raster line is referred to as a "normal raster line", and an image region of the input image formed by normal raster lines is referred to as a "normal recording region". When the printer 20 is a serial printer, a normal raster line is recorded in a single pass.

The penetrant liquid data are image data having the same number of pixels vertically and horizontally as those of the recorded data of the first ink, and are image data defining the dot-on of the penetrant liquid only for the pixels corresponding to the OL recording region. The penetrant liquid data are also referred to as the recorded data of the penetrant liquid. The penetrant liquid data may be data defining the dot-on of the penetrant liquid for all pixels corresponding to the OL recording region, or may be data defining the dot-on of the penetrant liquid for a portion of the pixels corresponding to the OL recording region.

In step S130, the recording control unit 12*b* performs output processing that causes the printer 20 to execute recording on the basis of the recorded data generated in steps S110 and S120. The recorded data referred to here are recorded data of the first ink and recorded data of the penetrant liquid. Specifically, the recorded data are sorted in the order of transfer to the printer 20 in accordance with the predetermined feed amount and nozzle usage rate. The processing of this sorting is also referred to as a rasterization processing. In the rasterization processing, the recording control unit 12*b* assigns each pixel constituting the OL raster lines among the raster lines constituting the recorded data to a plurality of passes in accordance with the nozzle usage rate. Of the plurality of passes for recording a given OL raster line, a prior pass is referred to as a preceding pass and a subsequent pass is referred to as a succeeding pass. The nozzle usage rate is a ratio of the number of pixels assigned to the preceding pass to the number of pixels assigned to the succeeding pass in the OL raster line.

The rasterization processing determines by which nozzle, at which pass, and at which timing the dots of the ink and the penetrant liquid defined by the recorded data are to be ejected, in accordance with the pixel position, the type of color, and the like. The recording control unit 12*b* transfers the information related to the recorded data and the feed amount after the rasterization processing to the printer 20. The printer 20 drives the transport mechanism 21, the recording head 22, and the carriage 24 on the basis of the recorded data and the feed amount thus transferred, thereby recording the input image onto the recording medium 30 along with the penetrant liquid.

Figure 4:
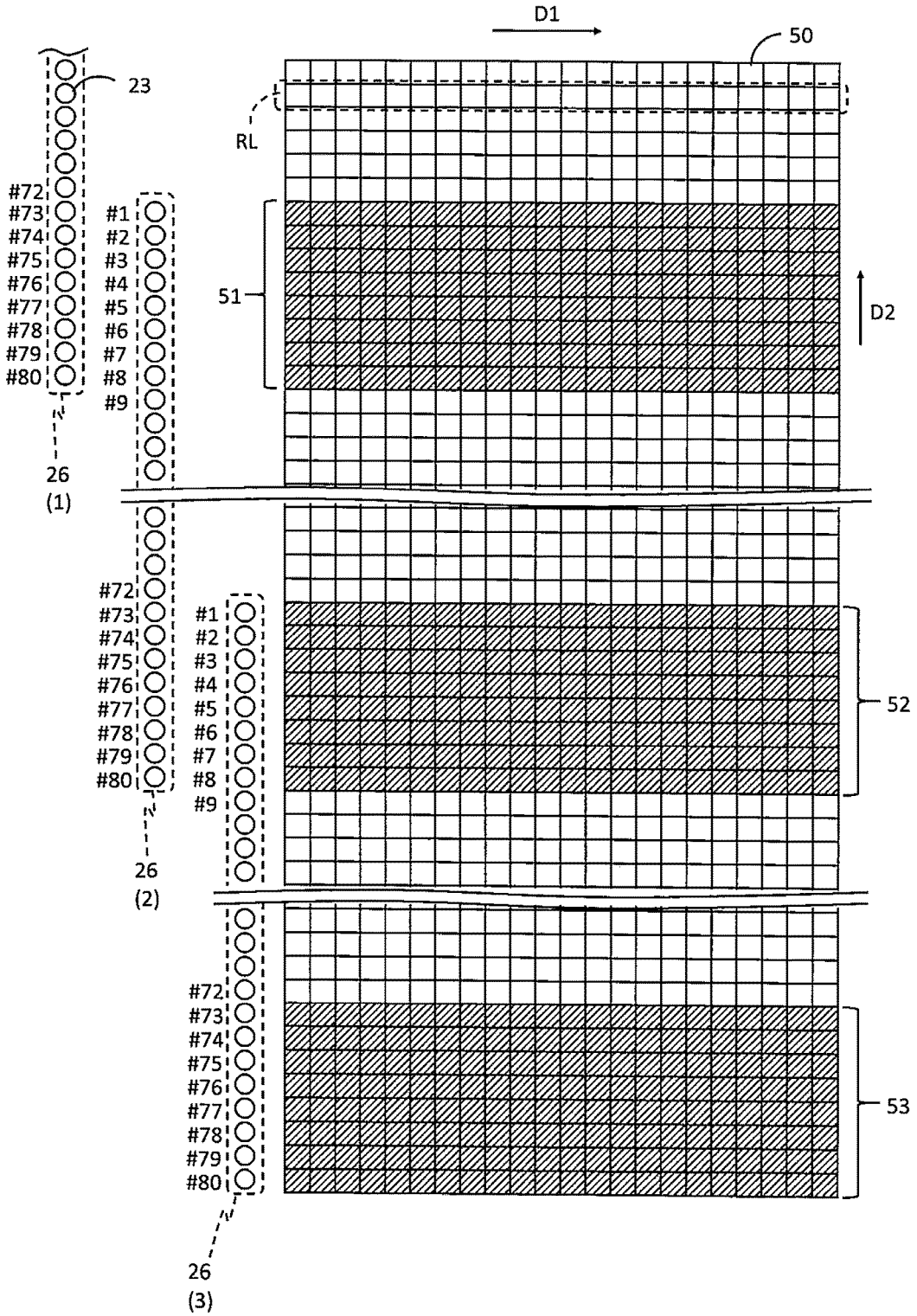
FIG. 4 is a diagram illustrating an assignment relationship between nozzles and pixels.

FIG. 4 illustrates a correspondence relationship of assignments between the nozzles 23 and the pixels. Reference sign 50 denotes a portion of the recorded data. Each rectangle constituting the recorded data 50 is a pixel of the recorded data 50. In FIG. 4, the recorded data 50 represents the data in a state in which the recorded data of the first ink generated in step S110 and the recorded data of the penetrant liquid generated in step S120 overlap. In FIG. 4, the correspondence relationship between the recorded data 50 and the directions D1 and D2 is also illustrated. Reference sign RL denotes a single pixel row, that is, one raster line, in which a plurality of pixels are aligned in correspondence with the first direction D1.

FIG. 4 illustrates the nozzle row 26 formed of a plurality of the nozzles 23 configured to eject one color of ink. In FIG. 4, the nozzle row 26 is constituted by 80 nozzles 23 aligned in the second direction D2. For ease of understanding, the nozzles 23 constituting the nozzle row 26 in FIG. 4 are respectively assigned nozzle numbers #1 to #80 in order in the second direction D2, that is, from downstream to upstream in the transport direction. Upstream and downstream in the transport direction are simply referred as upstream and downstream. Of course, a configuration in which the number of nozzles in the nozzle row 26 is 80 is merely an example, and the number of nozzles in the nozzle row 26 is not limited. As described above, the recording head 22 includes the plurality of nozzle rows 26 corresponding to each of a plurality of types of liquid such as the CMYK ink and the penetrant liquid. The positional relationship between the nozzle row 26 and the recorded data 50 corresponding to the one color of ink described in FIG. 4 is common to the nozzle rows 26 of each ink and the penetrant liquid.

All of the nozzle rows 26 illustrated in FIG. 4 are the same as the nozzle row 26. That is, FIG. 4 illustrates the relative positional relationship between the nozzle row 26 and the recorded data 50 in the second direction D2 changing for each pass of the recording head 22. In FIG. 4, numbers such as 1, 2, 3 . . . in parentheses together with the reference sign 26 indicate the number of the pass corresponding to the nozzle row 26 at that time. In FIG. 4, the nozzle row 26 appears to move upstream each time the number of the pass increases. Actually, the transport mechanism 21 transports the recording medium 30 downstream by the feed amount between passes, thereby reproducing the positional relationship between the nozzle row 26 and the recorded data 50 for each pass such as illustrated in FIG. 4 as the recording result on the recording medium 30. In FIG. 4, the nozzle row 26 for each pass is illustrated as being shifted in the first direction D1, but this is for ease of illustration and is not meant to be a difference in position per pass of the nozzle row 26 in the first direction D1.

In the example of FIG. 4, the feed amount between passes by the transport mechanism 21 is a distance of 72 times the nozzle pitch. Thus, the respective raster lines RL recorded by the respective nozzles 23 of the upstream nozzle numbers #73 to #80 of the nozzle row 26 in a given pass can be recorded by the respective nozzles 23 of the downstream nozzle numbers #1 to #8 of the nozzle row 26 in the next pass. That is, the respective nozzles 23 of the nozzle numbers #1 to #8 and the respective nozzles 23 of the nozzle number #73 to #80 have a positional relationship capable of recording the common raster line RL, and realize the recording by the OL mode. As understood from FIG. 4, for example, the raster line RL recorded by the nozzle 23 of the nozzle number #73 in a given pass can be recorded by the nozzle 23 of nozzle number #1 in the next pass.

In FIG. 4, regions 51, 52, 53 of the recorded data 50 that are hatched are specific examples of the OL recording region, and regions other than the OL recording regions 51, 52, 53 are normal recording regions. Each of the raster lines RL constituting the OL recording regions 51, 52, 53 is an OL raster line. The hatching in the recorded data 50 is for convenience for identifying the OL recording regions 51, 52, 53, and is not related to the dot-on or the dot-off of each pixel expressed by the recorded data 50. However, when limited to, among the recorded data 50, the recorded data of the penetrant liquid, the dot-on is defined only in the OL recording regions 51, 52, 53 marked with these hatches.

In the example of FIG. 4, a nozzle range of the nozzle numbers #1 to #8 is referred to as a "downstream OL nozzle range", and a nozzle range of the nozzle numbers #73 to #80 is referred to as an "upstream OL nozzle range". For each of the raster lines RL constituting the OL recording region 51, the recording control unit 12*b* assigns pixels to the nozzle 23 of the upstream OL nozzle range in the nozzle row 26 of the first pass and to the nozzle 23 of the downstream OL nozzle range in the nozzle row 26 of the second pass, in accordance with the nozzle usage rate described above. For example, for the most downstream raster line RL in the OL recording region 51, a portion of the pixels constituting this raster line RL is assigned to the nozzle 23 of the nozzle number #73 of the first pass and the remaining pixels constituting this raster line RL are assigned to the nozzle 23 of the nozzle number #1 of the second pass, in accordance with the nozzle usage rate.

Similarly, according to FIG. 4, for each of the raster lines RL constituting the OL recording region 52, the recording control unit 12*b* assigns pixels to the nozzle 23 of the upstream OL nozzle range in the nozzle row 26 of the second pass and to the nozzle 23 of the downstream OL nozzle range in the nozzle row 26 of the third pass. Similarly, for each of the raster lines RL constituting the OL recording region 53, the recording control unit 12*b* assigns pixels to the nozzle 23 of the upstream OL nozzle range in the nozzle row 26 of the third pass and to the nozzle 23 of the downstream OL nozzle range in the nozzle row 26 of the fourth pass. In FIG. 4, the nozzle rows 26 of the fourth and subsequent passes are not illustrated due to space limitations.

For each of the raster lines RL constituting the normal recording region of the recorded data, the recording control unit 12*b* assigns all of the pixels in the raster line RL to the corresponding nozzle 23 having a single nozzle number to record one raster line RL in a single pass. According to FIG. 4, for the adjacent raster line RL at a position downstream of the OL recording region 51, for example, the recording control unit 12*b* assigns all of the pixels constituting this raster line RL to the nozzle 23 of the nozzle number #72 of the first pass. Further, for example, for the raster line RL adjacent to the OL recording region 52 at a position downstream of the OL recording region 52, all of the pixels constituting this raster line RL are assigned to the nozzles 23 of the nozzle number #72 of the second pass.

As a result of step S130 which includes such assignment processing, of the input image to be realized by the recorded data of the first ink, each of the raster lines RL in the OL recording regions 51, 52, 53 such as illustrated in FIG. 4 is recorded onto the recording medium 30 by the OL mode, and each raster line RL in the normal recording region is recorded onto the recording medium 30 in one pass. Additionally, the dots of the penetrant liquid are recorded onto the recording medium 30 on the basis of the recorded data of the penetrant liquid, in correspondence with each of the raster lines RL in the OL recording regions 51, 52, 53. Note that the dots of the penetrant liquid defined correspondingly to the respective raster lines RL of the OL recording regions 51, 52, 53 by the recorded data of the penetrant liquid are also assigned to the preceding pass and the succeeding pass and recorded by the OL mode in the same manner as each dot of the first ink.

Figure 5:
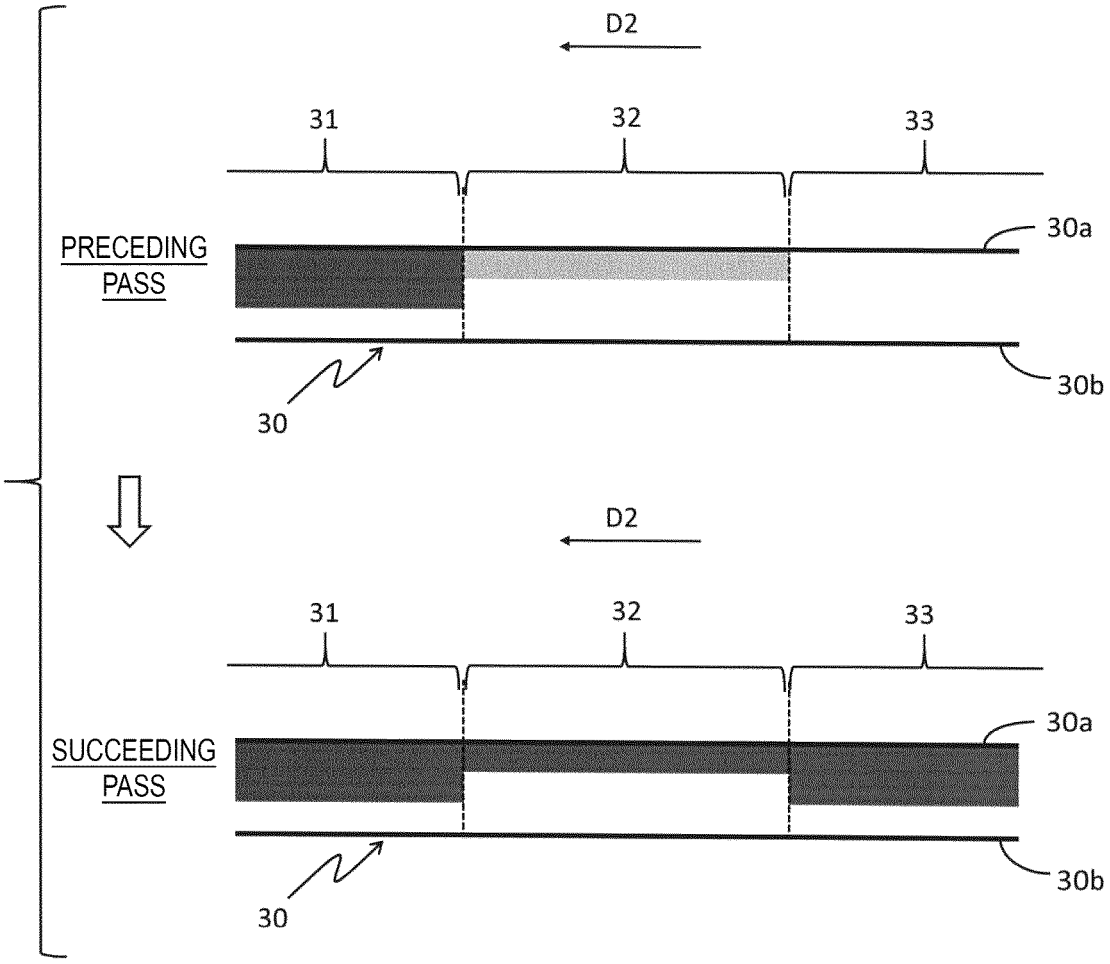
FIG. 5 is a diagram for explaining a recording method in the related art.
Figure 6:
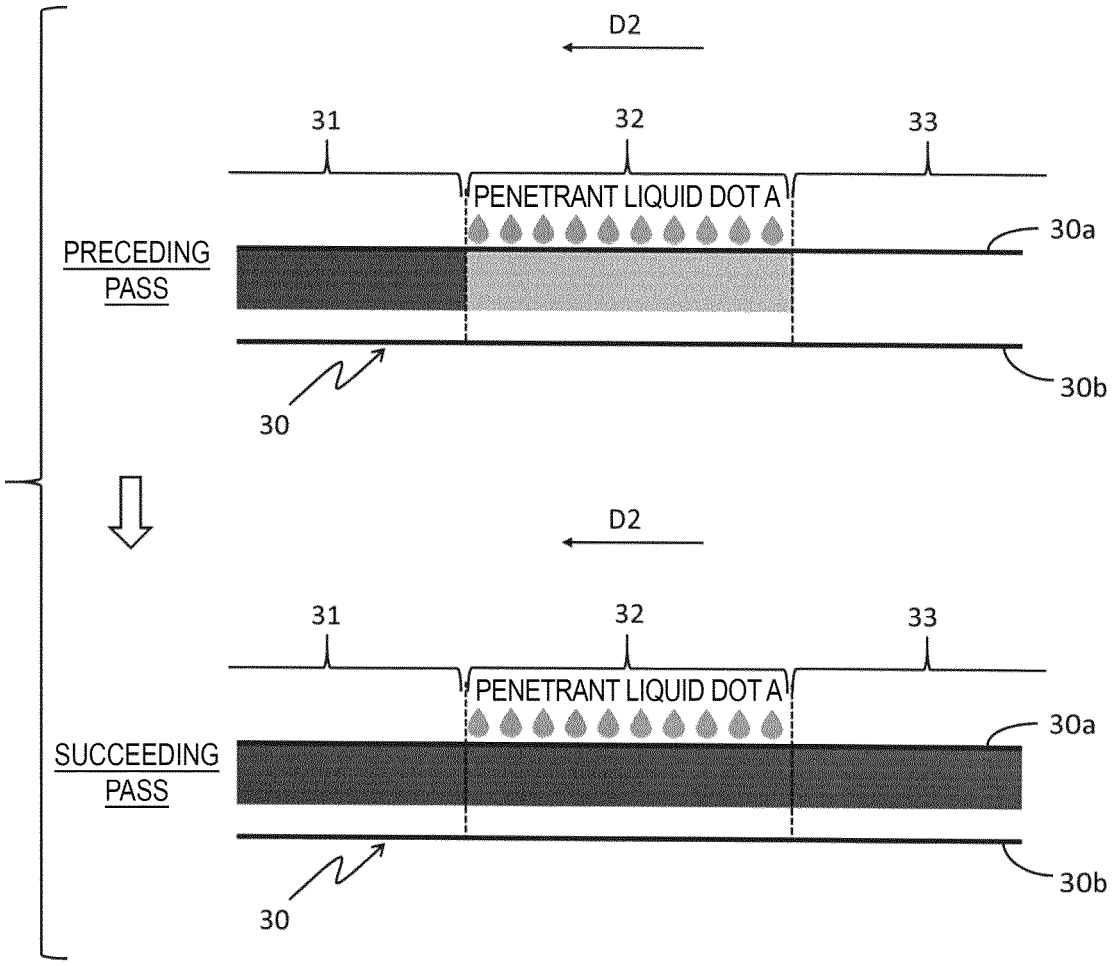
FIG. 6 is a diagram for explaining the exemplary embodiment by comparison with FIG. 5.

FIG. 5 is a diagram for explaining a recording method in the related art, and FIG. 6 is a diagram for explaining the recording method of this exemplary embodiment in comparison to FIG. 5. In FIG. 5, a portion of the recording medium 30 is illustrated from a viewpoint facing the first direction D1. Reference sign 30*a* denotes, of the two surfaces of the recording medium 30, a recording surface 30*a* that receives the ejection of ink by the recording head, and reference sign 30*b* denotes, of the two surfaces of the recording medium 30, a non-recording surface 30*b* opposite to the recording surface 30*a*. A distance between the recording surface 30*a* and the non-recording surface 30*b* is a thickness of the recording medium 30. The actual recording medium 30 does not have a thickness to the extent illustrated in FIG. 5.

Regions 31, 32, 33 of the recording surface 30*a* aligned from downstream to upstream are regions of the recording medium 30 recorded by a set of a preceding pass and a succeeding pass. Further, the region 32 interposed between the regions 31, 33 is recorded by the OL mode. Here, it is assumed that a solid image of the same color is recorded across the regions 31, 32, 33. FIG. 5 illustrates the ink being recorded in the region 31 and the region 32 by the preceding pass, and the ink being recorded in the region 32 and the region 33 by the succeeding pass via the transport of the feed amount. However, FIG. 5 does not express that the position of the recording medium 30 changes to downstream by the transport.

In FIG. 5, each rectangle shaded in the thickness of the recording medium 30 simply represents a density and a degree of penetration of the ink recorded in each of the regions 31, 32, 33. In the example in FIG. 5, the recorded amounts of ink per unit area at the end of the succeeding pass are the same in each of the regions 31, 32, 33. However, while the required amount of ink is recorded in its entirety in one pass in the regions 31, 33, the required amount of ink is recorded in two passes in the region 32, and therefore the degree of penetration of the ink ejected onto the recording surface 30*a* in one pass is low in the region 32 compared to those in the regions 31, 33. The degree of penetration of the ink refers to how far the ink penetrated from the recording surface 30*a* toward the non-recording surface 30*b*, and is also referred to as a strike-through of ink. A high degree of ink penetration is referred to as favorable strike-through, and a low degree of ink penetration is referred to as poor strike-through.

While the ink is recorded in the region 32 in two passes by the OL mode, ultimately the degree of penetration of the ink remains low in region 32 compared to those of the regions 31, 33, even when the recording having a low degree of penetration of ink per pass is performed twice. In this manner, because the region 32 has poor ink strike-through compared to those of the regions 31, 33, a greater amount of ink is biased near the recording surface 30*a*. Therefore, when the recording medium 30 after recording is observed from the recording surface 30*a*, the region 32 appears relatively darker in color than the region 31 and the region 33, and the density irregularity is visible. Further, the image quality of the non-recording surface 30*b* of the recording medium 30, which is fabric, is also evaluated. When the recording medium 30 after recording is observed from the non-recording surface 30*a*, the region 32 has a poorer strike-through and appears relatively lighter in color than the region 31 and the region 33, and the density irregularity is visible.

Next, the recording method according to this exemplary embodiment will be described with reference to FIG. 6. The way to view FIG. 6 is the same as that of FIG. 5. According to this exemplary embodiment, in addition to the ink, a penetrant liquid is ejected in, among the regions 31, 32, 33 of the recording medium 30, the region 32 by the OL mode. FIG. 6 schematically represents a state in which a dot A of the penetrant liquid is ejected in the region 32 by a preceding pass and a succeeding pass. The ejection of the dot A of the penetrant liquid promotes the penetration of the ink in the region 32. That is, in the region 32, a state in which a great amount of the ink is biased near the recording surface 30*a* as in the related art is eliminated, and favorable strike-through is achieved. Thus, when the recording medium 30 after recording according to this exemplary embodiment is observed from the recording surface 30*a*, there is almost no density difference between the region 32 and the regions 31, 33, and a density irregularity is not visible.

Further, when the recording medium 30 after recording is observed from the non-recording surface 30*b*, similar to the recording surface 30*a*, there is almost no density difference between the region 32 and the regions 31, 33, and a density irregularity is not visible.

Thus, according to this exemplary embodiment, the recording device 40 includes the recording head 22 including the plurality of first nozzles configured to eject the first ink and the plurality of second nozzles configured to eject the penetrant liquid that promotes penetration of the first ink into the recording medium 30, and the control unit 11 configured to control the recording head 22 to eject the first ink onto the recording medium 30, thereby recording onto the recording medium 30 an image including the plurality of raster lines extending in the first direction D1 and formed side by side in the second direction D2 intersecting the first direction. The control unit 11 is configured to cause the recording head 22 to record, among the plurality of raster lines, the raster lines of the overlapping region of the image by the OL mode of recording one raster line using a plurality of the first nozzles, and record the penetrant liquid in the at least a portion of the overlapping region by the second nozzles.

The control unit 11 causes the recording head 22 to record the penetrant liquid in a region of the image other than the overlapping region in an amount less than that of the penetrant liquid recorded in the at least a portion of the overlapping region. "In an amount less than that of the penetrant liquid recorded in the at least a portion of the overlapping region" includes zero. That is, this exemplary embodiment includes a mode in which the penetrant liquid is not recorded in a region of the image other than the overlapping region.

According to the configuration described above, in the image recorded by the first ink, the recording device 40 records a greater amount of penetrant liquid in the OL recording region, which is the overlapping region recorded by the OL mode, than in other regions. This makes it possible to increase the degree of penetration of the first ink in the OL recording region recorded onto the recording medium 30, and suppress the occurrence of density irregularity in the recording result.

Further, this exemplary embodiment discloses a recording method including controlling the recording head 22 including the plurality of first nozzles configured to eject the first ink and the plurality of second nozzles configured to eject the penetrant liquid that promotes penetration of the first ink into the recording medium to eject the first ink onto the recording medium 30, thereby recording onto the recording medium 30 an image including the plurality of raster lines extending in the first direction D1 and formed side by side in the second direction intersecting the first direction D1. According to the recording method, the recording method includes causing the recording head 22*d* to causing the recording head to record, among the plurality of raster lines, the raster lines of the overlapping region of the image by the OL mode of recording one raster line using a plurality of the first nozzles, record the penetrant liquid in the at least a portion of the overlapping region by the second nozzles, and record the penetrant liquid in the region of the image other than the overlapping region in an amount less than that of the penetrant liquid recorded in the at least a portion of the overlapping region.

3. Features of Nozzle Row Arrangement

According to this exemplary embodiment, the recording head 22 is configured to eject a plurality of types of the first ink having different colors, includes, for each color of the first ink, the first nozzle row including a plurality of the first nozzles aligned in the second direction D2, and includes the second nozzle row including a plurality of the second nozzles aligned in the second direction D2. Then, in the recording head 22, the first nozzle row for each color of the first ink and the second nozzle row are arranged side by side in the first direction D1, and the second nozzle row is positioned outermost among a plurality of the nozzle rows arranged side by side.

According to the configuration described above, during the recording by the OL mode in a given OL recording region, the recording device 40 can eject the penetrant liquid in the preceding pass before ejection of each of the first inks, and eject the penetrant liquid in the succeeding pass after ejection of each of the first inks. Specifically, in the configuration in FIG. 2, given that the preceding pass for recording in a given OL recording region is a forward movement of the carriage 24, it is possible to eject the penetrant liquid by the nozzle row 26A, subsequently eject the KYMC ink in the order of the nozzle rows 26K, 26Y, 26M, 26C, eject the CMYK ink in the order of the nozzle rows 26C, 26M, 26Y, 26K in the return movement of the carriage 24, which is the preceding pass for recording in the OL recording region, and subsequently eject the penetrant liquid by the nozzle row 26A. In this way, by ejecting the penetrant liquid at timings both before and after ejection of the first ink, it is possible to further increase the degree of penetration of the first ink into the recording medium 30 in the OL recording region and increase the effect of suppressing density irregularity.

Figure 7:
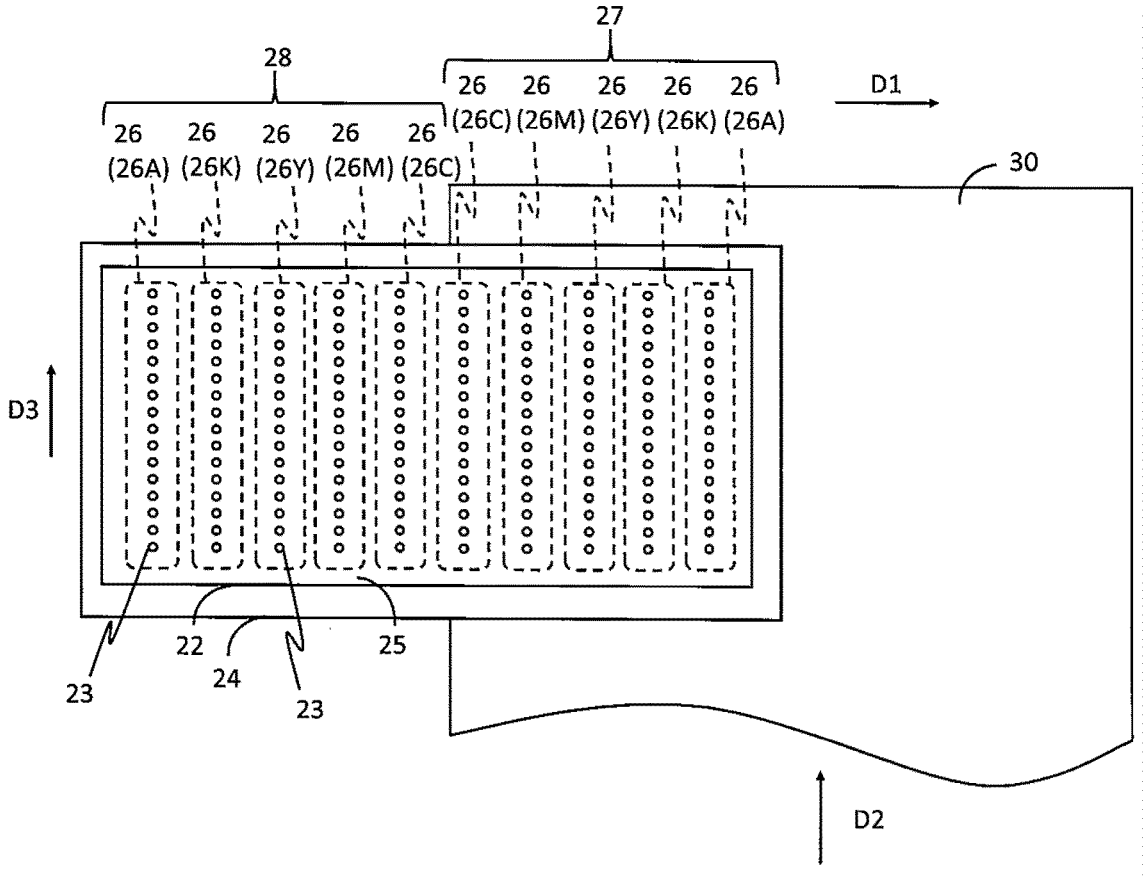
FIG. 7 is a diagram illustrating a recording head having a left-right symmetrical structure from a perspective similar to that of FIG. 2.

As a suitable example for realizing the ejection order of the penetrant liquid→first ink→first ink→penetrant liquid for all OL recording regions, the recording head 22 having a left-right symmetrical structure such as illustrated in FIG. 7 may be employed. The way to view FIG. 7 is the same as that of FIG. 2. According to FIG. 7, the recording head 22 on which the carriage 24 is mounted includes 10 rows in the order of the nozzle rows 26A, 26K, 26Y, 26M, 26C, 26M, 26Y, 26K, 26A, in the first direction D1. Such a left-right symmetrical structure is also a structure in which the second nozzle row, that is, the nozzle row 26A that ejects the penetrant liquid, is positioned outermost in the order of the plurality of nozzle rows 26.

The nozzle row 26 on the right half of the recording head 22 of FIG. 7, that is, the nozzle rows 26C, 26M, 26Y, 26K, 26A positioned frontward in the travel direction during the forward movement of the carriage 24, are collectively referred to as a first group 27. On the other hand, the nozzle row 26 on the left half, that is, the nozzle rows 26A, 26K, 26Y, 26M, 26C positioned frontward in the travel direction during the return movement of the carriage 24 are collectively referred to as a second group 28. The recording head 22 in FIG. 2 can be said to have a configuration including only, of the first group 27 and the second group 28, the first group 27.

In the recording of the OL recording region in which the preceding pass is the forward movement of the carriage 24 and the succeeding pass is the return movement, the control unit 11 may use the first group 27 in the preceding pass and the succeeding pass. On the other hand, in the recording of the OL recording region in which the preceding pass is the return movement of the carriage 24 and the succeeding pass is the forward movement, the control unit 11 may use the second group 28 in the preceding pass and the succeeding pass.

As a specific example, assume that the first pass, the third pass, and the like illustrated in FIG. 4 are each a forward movement of the carriage 24, and the second pass and the like illustrated in FIG. 4 are each a return movement of the carriage 24. In this case, the preceding pass (first pass) for recording the OL recording region 51 is a forward movement. Accordingly, the control unit 11 may use the upstream OL nozzle range of each of the nozzle rows 26 of the first group 27 to record the OL recording region 51 in the first pass, and use the downstream OL nozzle range of each the nozzle rows 26 of the first group 27 to record the OL recording region 51 in the second pass. With such a configuration, when the OL recording region 51 is recorded onto the recording medium 30 by the OL mode, an order of ejection of the penetrant liquid→first ink→first ink→penetrant liquid can be realized.

Further, the preceding pass (second pass) for recording the OL recording region 52 is a return movement. Accordingly, the control unit 11 may use the upstream OL nozzle range of each of the nozzle rows 26 of the second group 28 to record the OL recording region 51 in the second pass, and use the downstream OL nozzle range of each of the nozzle rows 26 of the second group 28 to record the OL recording region 52 in the third pass. With such a configuration, when the OL recording region 52 is recorded onto the recording medium 30 by the OL mode, an order of ejection of the penetrant liquid→first ink→first ink→penetrant liquid can be realized.

Of course, the arrangement of the nozzle rows 26 illustrated in FIG. 2 and FIG. 7 is an example. The disclosure according to this exemplary embodiment includes structures in which the nozzle row 26A is not positioned outermost in the order of the plurality of nozzle rows 26. For example, the nozzle row 26A may be in a position interposed between the nozzle rows 26, which eject the first ink, in the first direction D1.

4. Ejection Restrictions of Penetrant Liquid

While, in one of the exemplary embodiments, the penetrant liquid is recorded in the OL recording region of the input image, and the penetrant liquid is not recorded in the normal recording region as described above, the ejection of the penetrant liquid may be restricted under predetermined conditions, even within the OL recording region.

Figure 8:
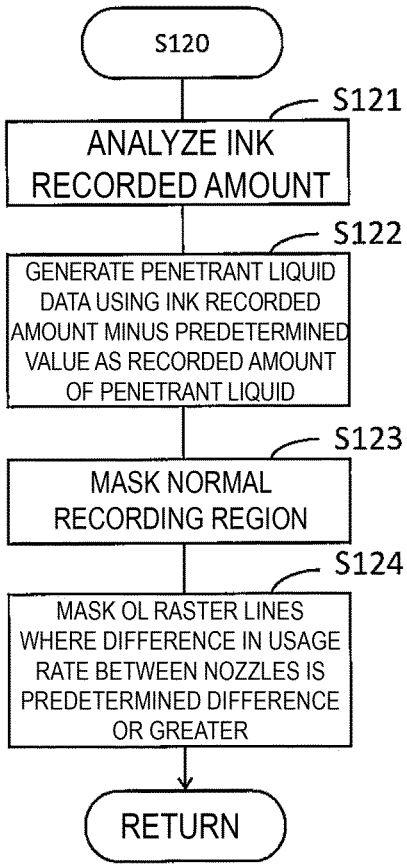
FIG. 8 is a flowchart illustrating step S120 including ejection restriction processing of a penetrant liquid.

FIG. 8 illustrates, by a flowchart, step S120 including ejection restriction processing of the penetrant liquid.

In step S121, the recorded data generation unit 12*a* analyzes the ink recorded amount on the basis of the recorded data of the first ink generated in step S110. "Analyzes the ink recorded amount" is a process of analyzing how much ink is to be recorded at which position of the input image. Here, assume that the recorded data of the first ink are data defining any of large dot-on, medium dot-on, small dot-on, and dot-off of each CMYK ink for each pixel.

When one large dot is defined for one pixel, for example, the recorded data generation unit 12*a* calculates the ink recorded amount of that pixel as 100%. Medium dots and small dots may be converted into large dots in accordance with a known size ratio with the large dot. For example, one medium dot is converted to 0.5 large dots. For example, a pixel having C ink=medium dot-on, M ink=dot-off, Y ink=dot-off, and K ink=large dot-on has an ink recorded amount of 150%. In this manner, the recorded data generation unit 12*a* identifies the ink recorded amount in the recorded data of the first ink.

Next, in step S122, the recorded data generation unit 12*a* generates image data having the same number of pixels in the horizontal and horizontal directions as those of the recorded data of the first ink, and sets the "ink recorded amount−Predetermined value" for each pixel of the image data as the recorded amount of the penetrant liquid. The ink recorded amount is, of course, the value for each pixel constituting the recorded data of the first ink analyzed in step S121. The predetermined value is, for example, 30%. Accordingly, for pixels having an ink recorded amount of 100% and for pixels in the same position in the recorded data of the first ink, the recorded data generation unit 12*a* sets the recorded amount of the penetrant liquid to 70%.

In this manner, the recorded data generation unit 12*a* generates the penetrant liquid data in which a value obtained by subtracting a predetermined value from the ink recorded amount of each pixel of the recorded data of the first ink is the recorded amount of the penetrant liquid for each pixel. Note that the value obtained by subtracting the predetermined value from the ink recorded amount is not information representing the dot-on or the dot-off of the penetrant liquid. Therefore, the recorded data generation unit 12*a* may generate the penetrant liquid data defining the dot-on or the dot-off of the penetrant liquid for each pixel by performing standardization to a gray scale range of 0 to 255 and halftone processing on the value obtained by subtracting the predetermined value from the ink recorded amount.

According to steps S121 and S122, for pixels in which the ink recorded amount is less than or equal to a predetermined value, the recorded amount of the penetrant liquid is 0%, and therefore the dot-off of the penetrant liquid is defined. A region of the input image including pixels having an ink recorded amount of less than or equal to the predetermined value is referred to as a "low duty region". Conversely, a region of the input image including pixels having an ink recorded amount exceeding the predetermined value is referred to as a "high duty region". The predetermined value used in step S122 can be said to be the threshold value that separates the high duty region and the low duty region.

In step S123, the recorded data generation unit 12*a* masks the entire normal recording region of the penetrant liquid data. "Masks" refers to forcibly setting all of the pixels in the region to be masked to dot-off. As a result of step 123, penetrant liquid data are generated that define the dot-on of the penetrant liquid to within the OL recording region and within the high duty region only.

The recorded data generation unit 12*a* may execute step S124 after step S123 or may complete step S120 after executing the steps through step S123.

By executing at least steps S121 to S123 in step S120, the control unit 11, as a result, causes the recording head 22 to record the penetrant liquid in the high duty region of the OL recording region, which is the overlapping region, where a recorded amount of the first ink is greater than a predetermined threshold value, and not record the penetrant liquid in the low duty region of the overlapping region where the recorded amount of the first ink is less than or equal to the threshold value.

In a region of the input image where the ink amount recorded onto the recording medium 30 is somewhat low, the user cannot substantially visually recognize density irregularity caused by a low degree of ink penetration. Accordingly, when the OL recording region is the low duty region, there is almost no improvement effect of image quality by recording the penetrant liquid. Therefore, in this exemplary embodiment, the penetrant liquid is not recorded in the low duty region of the OL recording region, thereby suppressing consumption of the penetrant liquid.

In step S124, the recorded data generation unit 12*a* masks, of the OL recording region of the penetrant liquid data, a given OL raster line in which a difference in usage rate between the plurality of nozzles 23 used for recording by the OL mode is greater than or equal to a predetermined difference.

FIG. 9 illustrates a nozzle usage rate table 60 defining nozzle usage rates. The nozzle usage rate table 60 is stored in a predetermined memory or the like in advance. In the nozzle usage rate table 60, the OL raster number and the nozzle usage rate of the preceding pass to the succeeding pass are associated with each other. The OL raster number is convenient information for identifying each of the OL raster lines forming one OL recording region. Referring to the example in FIG. 4, the OL recording regions 51, 52, 53 are each formed by eight rows of OL raster lines, and therefore the nozzle usage rate table 60 also defines the OL raster numbers of 1 to 8 in accordance with FIG. 4.

Lower OL raster numbers are associated with the OL raster lines further downstream. Accordingly, when the nozzle usage rate table 60 is applied to the OL recording region 51, the OL raster line furthest downstream in the OL recording region 51 is the OL raster line with an OL raster number of 1. Similarly, when the nozzle usage rate table 60 is applied to the OL recording region 52, the OL raster line furthest downstream in the OL recording region 52 is the OL raster line with an OL raster number of 1.

The nozzle usage rate table 60 is used in step S130 by the recording control unit 12*b* when assigning the pixels of the OL raster lines of the recorded data to the preceding pass and succeeding pass. That is, the recording control unit 12*b* carries out assignment by applying the nozzle usage rate corresponding to the OL raster number to each OL raster line forming the OL recording region For example, the most downstream raster line RL in the OL recording region 52 in FIG. 4 is OL raster number 1 and, according to the nozzle usage rate table 60, the nozzle usage rate of the preceding pass is 90% and the nozzle usage rate of the succeeding pass is 10%. In this case, the recording control unit 12*b* assigns 90% of all of the pixels constituting the raster line RL furthest downstream in the OL recording region 52 to the nozzle 23 having the nozzle number #73 of the second pass, which is the preceding pass for this raster line RL, and assigns the remaining 10% of the pixels constituting this raster line RL to the nozzle 23 having the nozzle number #1 of the third pass, which is the succeeding pass for this raster line RL.

According to the characteristics of the nozzle usage rate table 60, the further the OL raster line is downstream in the OL recording region, the greater number of pixels are recorded in the raster line in the preceding pass, and the further the OL raster line is upstream in the OL recording region, the greater number pixels are recorded in the raster line in the succeeding pass. However, the manner of assigning pixels to the preceding pass and the succeeding pass varies. The recording control unit 12*b* may, for example, randomly distribute each of the pixels constituting the OL raster line into the preceding pass and the succeeding pass. Of course, each of the pixels assigned to the nozzles 23 of the preceding pass and succeeding pass may be set to dot-on or dot-off. Therefore, the nozzle usage rate defined by the nozzle usage rate table 60 does not strictly represent the actual operation rate of each of the nozzles 23 used in the recording by the OL mode.

The nozzle usage rate table 60 thus referenced in step S130 is also referenced in step S124 by the recorded data generation unit 12*a*. The difference in usage rates between the plurality of nozzles 23 used in the recording by the OL mode is the difference between the nozzle usage rate of the preceding pass and the nozzle usage rate of the succeeding pass. According to the nozzle usage rate table 60, for example, the difference associated with the OL raster number 2 is 80%-20%=60%. In the example in FIG. 9, the difference between the nozzle usage rate of the preceding pass and the nozzle usage rate of the succeeding pass is included as a portion of the information of the nozzle usage rate table 60, but such a difference may simply be obtained by subtraction, and thus may not be included in the nozzle usage rate table 60.

In step S124, the predetermined difference described above is set to 60%, for example. In this case, the recorded data generation unit 12*a* may mask, among the raster lines forming the OL recording region of the penetrant liquid data, the OL raster lines for which the difference in the usage rate understood with reference to the nozzle usage rate table 60 is greater than or equal to 60%. The meaning of "mask" is as described in step S123. The example in FIG. 9 illustrates the correspondence relationship between the OL raster number and the dot-on/dot-off of the penetrant liquid in an easy-to-understand manner. According to the nozzle usage rate table 60, the recorded data generation unit 12*a* may mask the OL raster lines corresponding to the OL raster numbers 1, 2, 7, 8 among the OL raster lines forming the OL recording region of the penetrant liquid data. According to the example in FIG. 4, the OL raster lines corresponding to the OL raster numbers 1, 2, 7, 8 are the raster lines RL of two downstream rows and two upstream rows in each of the OL recording regions 51, 52, 53. Among the raster lines forming the OL recording region, the OL raster lines not to be masked in step S124 are each referred to as a first raster line, and the OL raster lines to be masked in step S124 are each referred to as second raster line.

By executing step S124 of step S120, the control unit 11, as a result, causes the recording head 22 to record the penetrant liquid in, among the plurality of raster lines of the OL recording region, which is the overlapping region, the first raster line where a difference in usage rate between the plurality of first nozzles used for recording by the OL mode is less than a predetermined difference, and not record the penetrant liquid in, among the plurality of raster lines of the overlapping region, the second raster line where the difference in usage rate is greater than or equal to the predetermined difference.

Even when the OL raster line is recorded, when recording is performed with the nozzle usage rate significantly biased to either the preceding pass or the succeeding pass, a recording result in which the degree of ink penetration is substantially as high as the recording result of the normal raster line can be obtained. Accordingly, for an OL raster line recorded with the nozzle usage rate significantly biased to either the preceding pass or the succeeding pass, there is little meaning to recording the penetrant liquid. From such a perspective, in this exemplary embodiment, the consumption of the penetrant liquid is suppressed by not recording the penetrant liquid in the second raster line in the OL recording region.

Note that, by performing steps S121 to S124 in step S120, the control unit 11, as a result, causes the recording head 22 to record the penetrant liquid in the region of the OL recording region corresponding to the first raster line and the high duty region.

Further, in step S120, the recorded data generation unit 12*a* may generate penetrant liquid data defining the dot-on of the penetrant liquid for the first raster line regardless of whether the region is the high duty region or the low duty region of the OL recording region.

Another modified example will now be described in relation to such an ejection restriction of the penetrant liquid.

The control unit 11 may be configured to cause the recording head 22 to record the penetrant liquid in a high duty region of the OL recording region, which is the overlapping region, and record the penetrant liquid in a low duty region of the overlapping region in an amount less than that of the penetrant liquid recorded in the high duty region. That is, instead of no penetrant liquid being recorded in the low duty region of the OL recording region, penetrant liquid in an amount less than that of the penetrant liquid recorded in the high duty region of the OL recording region is recorded. "Penetrant liquid . . . in an amount less than that of the penetrant liquid recorded in the high duty region of the OL" means a lesser amount when compared in terms of per unit area. Further, "penetrant liquid . . . in an amount less than that of the penetrant liquid recorded in the high duty region" may be an amount set in advance.

With such a configuration, it is possible to suppress the consumption of the penetrant liquid while suppressing density irregularity.

The control unit 11 may be configured to cause the recording head 22 to record the penetrant liquid in the first raster line of the raster lines of the OL recording region, which is the overlapping region, and record the penetrant liquid in the second raster line of the raster lines of the overlapping region in an amount less than that of the penetrant liquid recorded in the first raster line. That is, instead of no penetrant liquid being recorded in the second raster line of the OL recording region, penetrant liquid in an amount less than that of the penetrant liquid recorded in the first raster line in the OL recording region is recorded. "Penetrant liquid . . . in an amount less than that of the penetrant liquid recorded in the first raster line" means a lesser amount when compared in terms of per unit area. Further, "penetrant liquid . . . in an amount less than that of the penetrant liquid recorded in the first raster line" may be an amount set in advance.

With such a configuration, it is possible to suppress the consumption of the penetrant liquid while suppressing density irregularity.

The control unit 11 may cause the recording head 22 to record the penetrant liquid in the region of the image other than the overlapping region in an amount less than that of the penetrant liquid recorded in at least a portion of the overlapping region. That is, instead of no penetrant liquid being recorded in the normal recording region, which is the region other than the overlapping region, penetrant liquid in an amount less than that of the penetrant liquid recorded in the at least a portion of the overlapping region is recorded. "A region of at least a portion of the overlapping region" is, as understood from the explanations thus far, any one of the entire overlapping region, the high duty region of the overlapping region, the first raster line of the overlapping region, and the region corresponding to the first raster line and the high duty region of the overlapping region. "Penetrant liquid . . . in an amount less than that of the penetrant liquid recorded in at least a portion of the overlapping region" means a lesser amount when compared in terms of per unit area. Further, "an amount less than that of the penetrant liquid recorded in the at least a portion of the overlapping region" may be an amount set in advance.

With such a configuration, it is possible to suppress the consumption of the penetrant liquid while suppressing density irregularity.

5. Other Explanations

The printer 20 used in this exemplary embodiment may be a so-called line printer, such as described below, rather than a serial printer.

Figure 10:
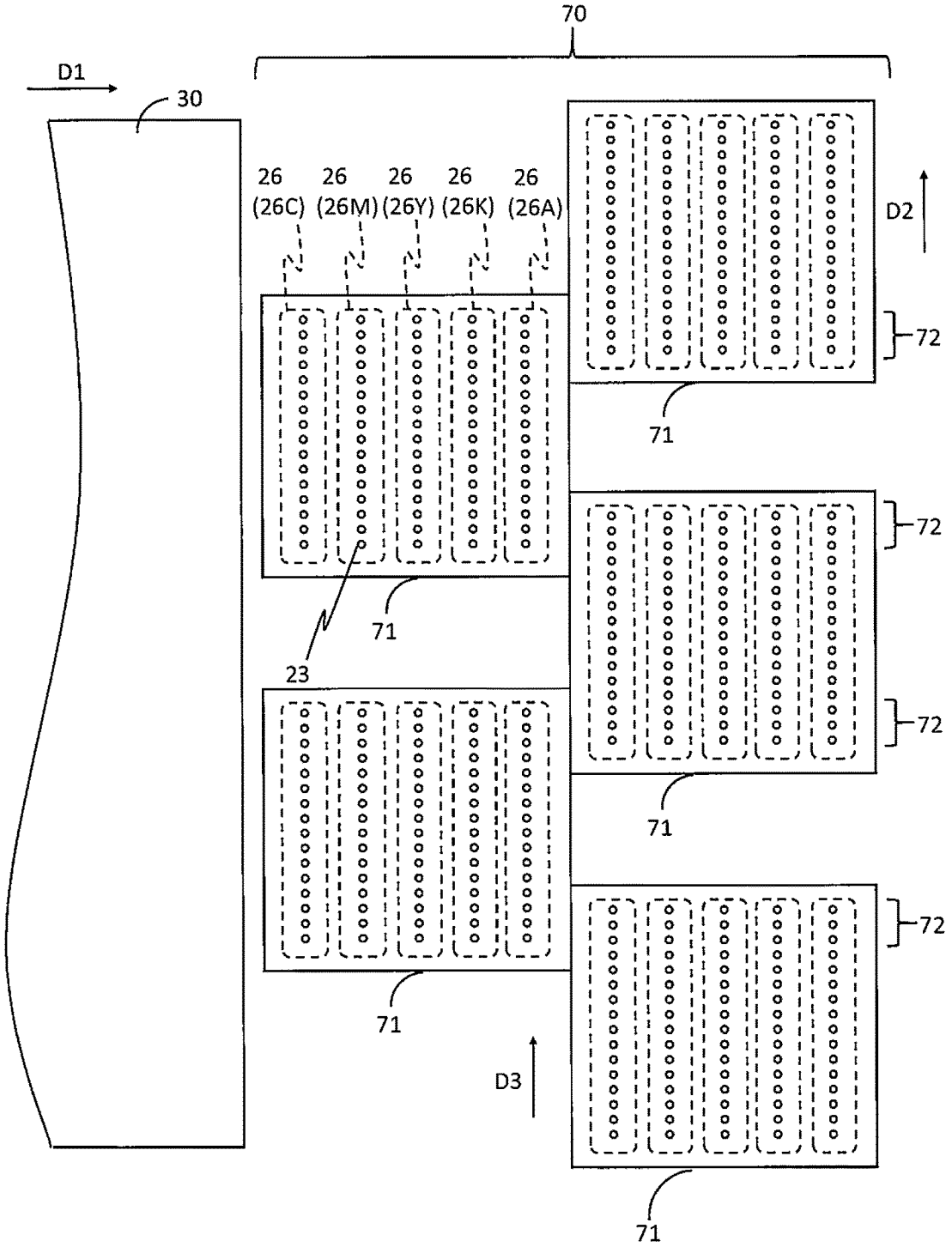
FIG. 10 is a diagram illustrating another example of the relationship between the recording medium and the recording head from a viewpoint from above.

FIG. 10 illustrates a simplified relationship between a recording head 70 and the recording medium 30 of the printer 20, which is a line printer. The printer 20, which is a line printer, includes the recording head 70 instead of the recording head 22, and does not include the carriage 24.

The relationship of the directions D1, D2, D3 is as previously described. However, when the printer 20 is a line printer, the second direction D2 is referred to as a width direction of the main scanning direction and the recording medium 30 rather than the transport direction, and the first direction D1 is referred to as the transport direction rather than the main scanning direction. The transport mechanism 21 transports the recording medium 30 in the first direction D1. The recording head 70 has a configuration in which a plurality of nozzle tips 71 having the same configuration are coupled in the second direction D2, extending at a length capable of covering the width of the recording medium 30, and is fixed in a predetermined position of the transport pass of the recording medium 30. Each of the nozzle tips 71 constituting the recording head 70 may be understood as having a configuration similar to that of the recording head 22 illustrated in FIG. 2. The recording head 70 ejects dots from each of the nozzles 23 onto the recording medium 30 transported in the first direction D1.

In other words, the configuration is one in which a plurality of the nozzle tips 71 of the nozzle rows 26C, 26M, 26Y, 26K, 26A are coupled in the second direction D2, and thus the entire recording head 70 has a length that can cover the width of the recording medium 30 and includes a nozzle row for each type of liquid, namely the CMYK ink and the penetrant liquid. According to the configuration of FIG. 10, the raster line is a line that extends in the transport direction. The nozzle tips 71 coupled to each other are coupled with a portion of the nozzle rows overlapping each other in the nozzle row direction D3. In this manner, recording by the OL mode is executed using the nozzles 23 having a nozzle range 72 in which a portion of the nozzle rows of the nozzle tips 71 overlap.

When the printer 20 is a serial printer, the printer 20 executes so-called bi-directional recording in which liquid is ejected from the recording head 22 in both the forward movement and the return movement of the carriage 24. Alternatively, the printer 20 may execute so-called one-directional recording in which liquid is ejected from the recording head 22 in only one of the forward movement and the return movement.

The recording medium 30 is not limited to a medium such as fabric in which image quality, such as the presence or absence of density irregularity, is evaluated on both the recording surface 30*a* and the non-recording surface 30*b*, and may be a medium such as paper in which image quality of only the recording surface 30*a* is evaluated.

What is claimed is:

1. A recording device comprising:

a recording head including a plurality of first nozzles configured to eject a first ink and a plurality of second nozzles configured to eject a penetrant liquid that promotes penetration of the first ink into a recording medium; and a control unit configured to control the recording head to eject the first ink onto the recording medium, thereby recording onto the recording medium an image including a plurality of raster lines extending in a first direction and formed side by side in a second direction intersecting the first direction, wherein the control unit is configured to cause the recording head to record each of the raster lines of an overlapping region of the image by an overlap mode of recording one raster line using a plurality of the first nozzles, record the penetrant liquid in at least a portion of the overlapping region by the second nozzles, and record the penetrant liquid in a region of the image other than the overlapping region in an amount less than that of the penetrant liquid recorded in the at least a portion of the overlapping region.

2. The recording device according to claim 1, wherein the control unit is configured to cause the recording head to record the penetrant liquid in a high duty region of the overlapping region where a recorded amount of the first ink is greater than a predetermined threshold value and not record the penetrant liquid in a low duty region of the overlapping region where the recorded amount of the first ink is less than or equal to the threshold value.

3. The recording device according to claim 1, wherein the control unit is configured to cause the recording head to record the penetrant liquid in a high duty region of the overlapping region where a recorded amount of the first ink is greater than a predetermined threshold value and record the penetrant liquid in a low duty region of the overlapping region where the recorded amount of the first ink is less than or equal to the threshold value, in an amount less than that of the penetrant liquid recorded in the high duty region.

4. The recording device according to claim 1, wherein the control unit is configured to cause the recording head to record the penetrant liquid in, among the raster lines of the overlapping region, a first raster line where a difference in usage rate between a plurality of the first nozzles used for recording by the overlap mode is less than a predetermined difference and not record the penetrant liquid in, among the raster lines of the overlapping region, a second raster line where the difference in the usage rate is greater than or equal to the predetermined difference.

5. The recording device according to claim 1, wherein the control unit is configured to cause the recording head to record the penetrant liquid in, among the raster lines of the overlapping region, a first raster line where a difference in usage rate between a plurality of the first nozzles used for recording by the overlap mode is less than a predetermined difference and record the penetrant liquid in, among the raster lines of the overlapping region, a second raster line where the difference in the usage rate is greater than or equal to the predetermined difference, in an amount less than that of the penetrant liquid recorded in the first raster line.

6. The recording device according to claim 1, wherein the control unit is configured to not cause the recording head to record the penetrant liquid in a region of the image other than the overlapping region.

7. The recording device according to claim 1, wherein the recording head is configured to eject a plurality of types of the first ink having different colors, includes, for each color of the first ink, a first nozzle row including a plurality of the first nozzles aligned in the second direction, and includes a second nozzle row including a plurality of the second nozzles aligned in the second direction, the first nozzle row for each color of the first ink and the second nozzle row are arranged side by side in the first direction, and the second nozzle row is positioned outermost among a plurality of the nozzle rows arranged side by side.

8. A recording method of controlling a recording head including a plurality of first nozzles configured to eject a first ink and a plurality of second nozzles configured to eject a penetrant liquid that promotes penetration of the first ink into a recording medium to eject the first ink onto the recording medium, thereby recording onto the recording medium an image including a plurality of raster lines extending in a first direction and formed side by side in a second direction intersecting the first direction, the recording method comprising:

causing the recording head to record each of the raster lines of an overlapping region of the image by an overlap mode of recording one raster line using a plurality of the first nozzles, record the penetrant liquid in at least a portion of the overlapping region by the second nozzles, and record the penetrant liquid in a region of the image other than the overlapping region in an amount less than that of the penetrant liquid recorded in the at least a portion of the overlapping region.

* * * * *